US006475108B1

(12) United States Patent
Sarenana, Sr. et al.

(10) Patent No.: US 6,475,108 B1
(45) Date of Patent: Nov. 5, 2002

(54) SOCCER KICKING TRAINING DEVICE

(75) Inventors: Chris David Sarenana, Sr.; Betty Romero Sarenana, both of Riverside, CA (US)

(73) Assignee: Chris D. Sarenana, Sr., Riverside, CA (US)

( * ) Notice: Subject to any disclaimer, the term of this patent is extended or adjusted under 35 U.S.C. 154(b) by 0 days.

(21) Appl. No.: 09/703,227

(22) Filed: Oct. 31, 2000

Related U.S. Application Data

(60) Provisional application No. 60/162,944, filed on Nov. 2, 1999.

(51) Int. Cl.[7] ..... A63B 69/00; A63B 71/00

(52) U.S. Cl. ..... 473/420; 473/422; 473/429; 473/417; 273/348; 273/127 R

(58) Field of Search ..... 473/415, 417, 473/422–429, 138, 139, 148, 149, 386, 387, 394, FOR 103; 124/4, 6

(56) References Cited

U.S. PATENT DOCUMENTS

| | | | | | |
|---|---|---|---|---|---|
| 3,550,938 | A | * | 12/1970 | Cunningham, Jr. | 473/429 X |
| 4,307,888 | A | | 12/1981 | Ohle | |
| 4,561,661 | A | | 12/1985 | Walker et al. | |
| 4,616,834 | A | | 10/1986 | Davis | |
| 4,790,529 | A | | 12/1988 | Pelle | |
| 4,865,330 | A | | 9/1989 | D'Amico | |
| 4,989,866 | A | * | 2/1991 | Dill | 473/417 X |
| 5,037,113 | A | | 8/1991 | Sowards | |
| D323,010 | S | | 1/1992 | Riahi | |
| 5,280,922 | A | | 1/1994 | Jones | |
| 5,435,572 | A | | 7/1995 | Covel | |
| 5,553,848 | A | * | 9/1996 | Amron | 473/429 X |
| 5,605,326 | A | * | 2/1997 | Spear, Jr. | 473/422 |
| 5,611,539 | A | * | 3/1997 | Watterson et al. | 473/429 X |
| 5,613,678 | A | * | 3/1997 | McKee et al. | 473/417 X |
| 5,873,798 | A | | 2/1999 | Bostick | |
| 5,957,781 | A | | 9/1999 | Kelly | |
| 6,030,299 | A | * | 2/2000 | Denny | 473/423 X |

* cited by examiner

*Primary Examiner*—Paul T. Sewell
*Assistant Examiner*—Mitra Aryanpour

(57) ABSTRACT

A soccer kicking training device used for placement on a surface and for allowing a soccer ball to be kicked thereof. The soccer ball kicking training device includes a base with stationary base connector and horizontal and vertical members, two ball holder means, a height adjustment means, and a ball. The base is supported by a surface in a horizontal plane with weighted material used to help stabilize the device. The stationary base connector is attached to the base and provides height adjustment. A vertical member and horizontal member slides freely inside the stationary base connector, which provides further height adjustments to the soccer kicking training device. A top and side ball holder by which a ball can be mounted and/or attached, by which a player standing on a surface can kick a stationary ball. The soccer kicking training device has quick setup and is easily transportable to and from the soccer field. The present invention teaches basic soccer principals used in kicking side volleys and front volleys into the goal.

9 Claims, 3 Drawing Sheets

SOCCER KICKING TRAINING DEVICE

RELATED APPLICATION

This application is related to and claims the benefit of the Provisional Application No. 60/162,944 filed on Nov. 2, 1999, and which is hereby incorporated by reference.

FIELD OF THE INVENTION

The present invention relates to a new ball-kicking training and practice device for soccer, teaching players proper kicking techniques. More specifically, it relates, as a teaching aid to soccer players in kicking volley and half-volley kicks while the ball stays stationary.

BACKGROUND OF THE INVENTION

This invention relates to a soccer kicking training device that aids soccer players on how to properly kick front and side volleys into a goal or a returning rebounding net. The present invention is advantageous over "prior art", because it shows the player his or her results after kicking the ball. Players must be able to make natural body movements that relate to actual field conditions. When the ball of concern is a soccer ball, general varieties of soccer kick-training devices are utilized. Existing soccer training devices have either elasticized cords, soccer balls connected to a pedestal. Tethered devices that consist of an unduly number of parts, which cause them to be overly complicated, unreasonably expensive, or difficult to adjust. Many of these devices have shortcomings because setup time is not quick enough or they are not easily transportable to and from the practice field. In addition, some of these devices require special tools or fasteners for assembling and disassembling. Other problems with prior art are soccer players wearing soccer cleats stepping on elastic cords and flat platforms to perform their kicks can be dangerous.

It is desirable to provide a soccer kicking training device, which overcomes the drawbacks of the prior art without being complex in structure and function. These problems are solved with the present invention by giving the ball a true flight into the goal, once it is kicked. It further remains desirable to provide a soccer kicking training device that teaches players how to properly kick front volleys and side volleys. It is also desirable to provide a device, which is compact and can be easily carried to any location. The support foot stays on a natural surface that applies to real field conditions. The present invention has easy setup time and is easily transportable to and from the soccer field. Soccer players need to see their results after kicking a soccer ball into the goal in order to gain confidence on the soccer field. None of these prior art devices provides those results. These devices are limited and none of these devices is specifically directed to the concept of providing a training mechanism, which can give soccer players actual field conditions that relates to the game of soccer. The present invention gives our next generation of soccer players the competitive edge to making them that all around soccer player.

Examples of such prior art can be found in U.S. Pat. No. D323,010, U.S. Pat. Nos. 4,307,888, 4,561,661, 4,616,834, 4,790,529, 4,865,330, 5,037,113, 5,280,922, 5,435,572, 5,873,798, and 5,957,781.

U.S. Pat. No. 5,957,781, issued to Kelly, U.S. Pat. No. 5,873,798, issued to Bostick, U.S. Pat. No. 5,280,922, issued to Jones, and U.S. Pat. No. Des. 323,010, issued to Riahi show devices for training an individual to kick balls tethered to vertical and horizontal members. Elastic tethers used for ball return and step on platforms do not give realistic field conditions. The use of elastic tethers on vertical poles requires time for the ball to come to a rest and the player does not know the results of the ball that was kicked. The use of tethered devices supported by a horizontal pole limits movement of the ball and requires time for the ball to come to rest. Devices with horizontal poles in direct line of the player kicking the ball prove to be an obstacle in line of sight of the player. These devices either are too heavy or are not easily transportable to and from the soccer field.

U.S. Pat. No. 4,307,888, issued to Ohle, U.S. Pat. No. 4,561,661, issued to Walker, U.S. Pat. No. 4,616,834, issued to Davis, and U.S. Pat. No. 5,037,113, issued to Sowards illustrates devices for training an individual to kick balls with a ball attached to a horizontal positioned rod with a base and/or pedestal. The ball stays within the given distance by the horizontal post or a coil spring. The result of a ball kicked using these devices does not simulate actual fielded conditions. With these devices, the ball is attached to a horizontal positioned post or rod, which can be swiveled about a base. The ball travels an exclusively horizontal motion, which in no way corresponds to the flight of a ball after it is kicked. In the case of the Sowards device, it is limited to dribbling by linking a ball to a spring. The ball stays in a fixed position, which cannot be used to kick a ball and cannot be adjusted to different heights. These devices either are too heavy or are not easily transportable to and from the soccer field. Injury can occur if the elastic bands break or a whipping action occurs on their ball return. [These devices do not offer a realistic situation on the soccer field. U.S. Pat. No. 4,790,529, issued to Pelle, shows an apparatus for exercising and training. The Pelle Patent shows a device with parallel bars, which form a track for a ball. The device does not provide proper kicking stroke and proper contact of the instep of the foot relative to actual field conditions. The device is limited to the power stroke of the leg and foot used to perform kicks on the field. Because the distance between the parallel bars is small, the kick must be performed slowly as not to injure the player. Speed and power is used on the field. The device has no means of stabilization when the ball is kicked. Height on this device is limited to the speed of the ball and adjustments cannot be made quickly.

U.S. Pat. No. 4,865,330, issued to D'Amico, shows an apparatus for training an individual to kick balls. The D'Amico Patent shows a device holding a soccer ball at [different heights and ball placement positions. The device does not provide proper kicking stroke and proper contact of the instep of the foot relative to actual field conditions. The device is limited to the size of a soccer ball used and height adjustments are limited. Injury could occur when the player approaches and kicks the ball through the structure used to guide the kicking foot.

U.S. Pat. No. 5,435,572, issued to Covel, shows an apparatus for training an individual to kick balls. The Covel Patent shows the user stepping on a platform with either leg and kicks a half size ball. This device has numerous components, proves to be difficult to put together, and requires special tools to assemble. The ball moves only in one direction and has no height adjustments. Other problems with this device are that soccer players wearing soccer cleats stepping on a flat platform to perform their kicks can be dangerous. This device does not create a realistic condition on the soccer field. It is also desirable to provide a device, which is compact and can be easily carried to any location.

SUMMARY OF THE INVENTION

The present invention gives the soccer player the ability to improve their game in a shorter amount of time. All players would benefit in using this soccer kicking training device. The present invention is comprised of a base, stationary base connector and a vertical and horizontal member. Handles on the base will allow coaches and soccer players to transport the present invention to and from the practice field and game. Weighted material is used to stabilize the present invention. Centrally located is a stationary base connector protruding upwards with a vertical member. Adjustments may be made in increments of inches or may be made to adjust in every quarter or half-inch increments. Adjustable locking pins or threaded knobs can be used to lock in the various heights on the present invention. Adjustments can also be made using a screw adjustment means on the vertical member to allow the various heights adjustments. A top ball holder is coupled and located on the top of the vertical member. The top ball holder will be shaped to allow a ball to rest on top. A ball of predetermined size may be used on the top ball holder.

The present invention includes a horizontal member protruding from the side of the vertical member with a side ball holder with means of attachment to the horizontal member. Adjustments may be made in increments of inches or may be made to adjust in every quarter or half-inch increments. Adjustable locking pins or threaded knobs can be used to lock the various heights. Adjustments can also be made using a screw adjustment means on the vertical member to allow for the various heights. The side ball holder may consist of VELCRO. A ball of predetermined size may be used on the side ball holder.

The present invention overcomes problems with forwards or halfbacks who lack the proper technique in kicking a soccer ball while it is in mid air. Soccer players must make quick judgements when kicking a soccer ball as it bounces at different heights on the soccer field. Soccer players tend to kick the ball over the crossbar or outside the near and far post because they lack the basic skills used in kicking front volleys and side volleys into the goal. The present invention helps players to concentrate on eye and ball coordination, along with body and foot positioning when kicking the ball from the top and side ball holder. A soccer ball fixed in a stationary position would give the player time to concentrate on the basic principals used in kicking a front volley or side volley. In addition, the present invention would teach players touch on the ball while using the inside and outside part of the foot to make passes while the ball is in midair. The present invention simulates actual field conditions that would greatly benefit the soccer player. The player can run up next to the invention and freeze before they kick the ball. Coaches and players can see the mistakes they are making before they attempt to kick the ball. The top and side ball holder keeps the ball stationary, which eliminates the pressure soccer players have rushing to kick a soccer ball while it is in mid air at full motion. The present invention becomes a great trainer for a goalie on how to handle hard volleys that are shot into the goal.

The present invention helps solve the players kicking technique when kicking front volleys and side volley. Players fail to get the supporting foot in the right position, improper use of their instep and not keeping the knee over the ball. Instead of leaning forward soccer players tend to lean back on the ball, thereby kicking the soccer ball over the crossbar. All these techniques listed above must be performed properly in order to project the ball low and into the goal. Players have problems when kicking a side volley when they fail to get the supporting foot in the proper position. Not keeping the thigh and knee parallel to the ground and failing to properly use their instep. If the thigh and knee is angled up, the ball is projected up over the crossbar.

The present invention also allows the user to use either foot in alternating succession and the top and side ball holder can be easily adjusted to the desired height. Because players need to learn to be equally proficient in using their left and right foot, the present invention teaches players to kick right and left front volleys, half-volleys, right and left side volleys. The present invention corrects all matters specified above.

The present invention will also help an individual to refine their movements that are necessary and do actually occur on the soccer field. The setup is quick and is easily transportable to and from the soccer field. The present invention device can be used indoors or outdoors. It can be used to teach beginner, intermediate, and advanced players. Beginners will build their confidence in a much shorter amount of time and advanced players will find the device a great training tool to hone their skills on the practice field. This soccer kicking training device can be adjusted to accommodate soccer players of different heights. The top ball holder will easily collapse if the soccer player kicks and misses the ball.

DESCRIPTION OF THE DRAWINGS

The following is a brief description of the drawings.

REFERENGE NUMERALS IN DRAWINGS

| | | | |
|---|---|---|---|
| 10 | Base | 12 | Stationary Base Connector |
| 14 | Vertical Member | 16 | Top Ball Holder |
| 18 | Horizontal Member | 20 | Side Ball Holder |
| 22 | Present Invention | 24 | Locking Pins |

DESCRIPTION OF THE INVENTION

Figure 1:
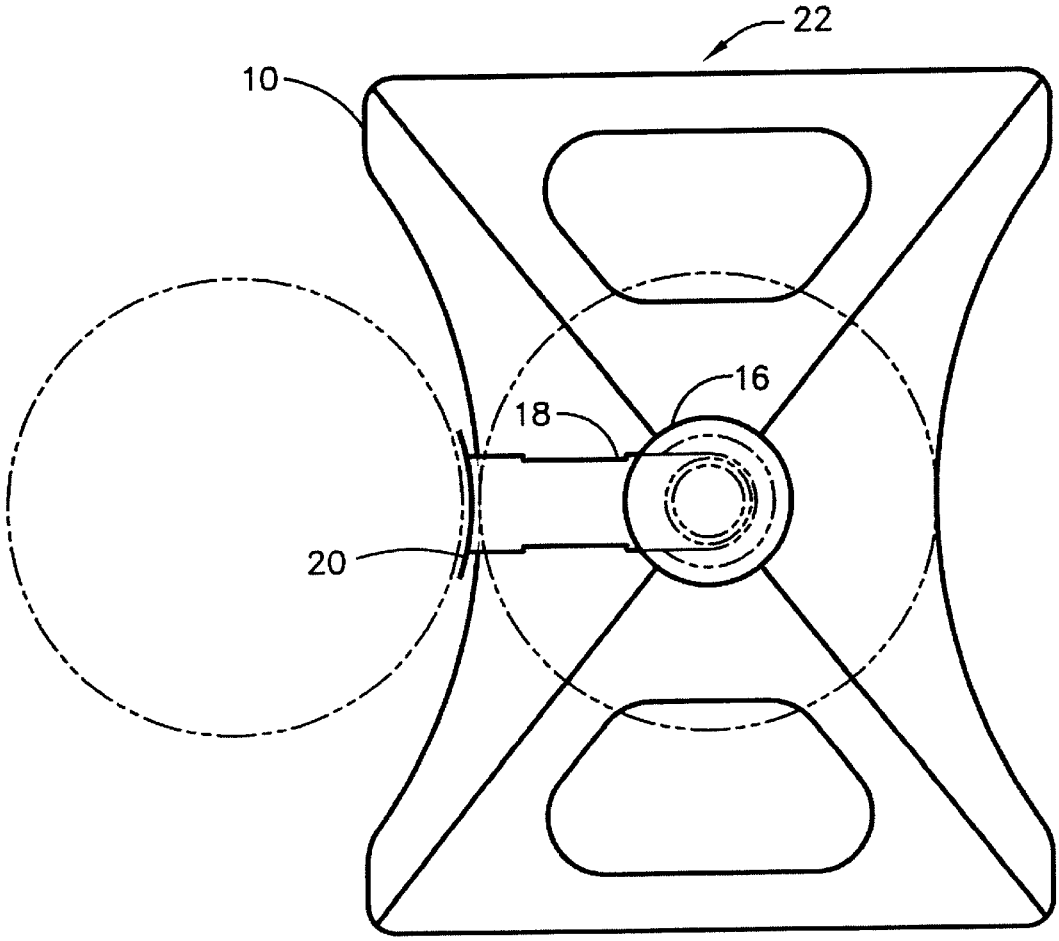
FIG. 1 is a top view of the subject invention. Sheet 1/3.
Figure 2:
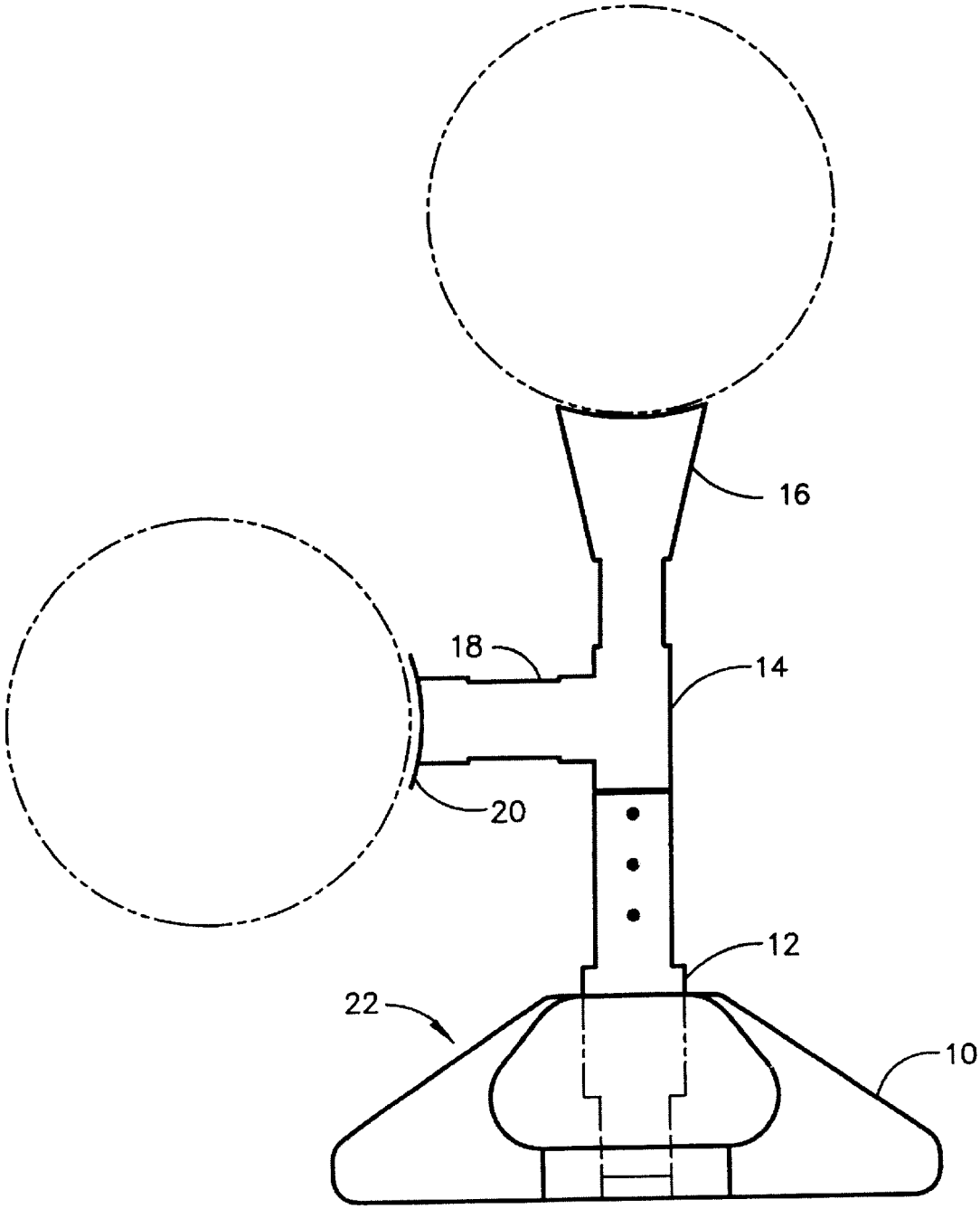
FIG. 2 is a front view of FIG. 1. Sheet 2/3.
Figure 3:
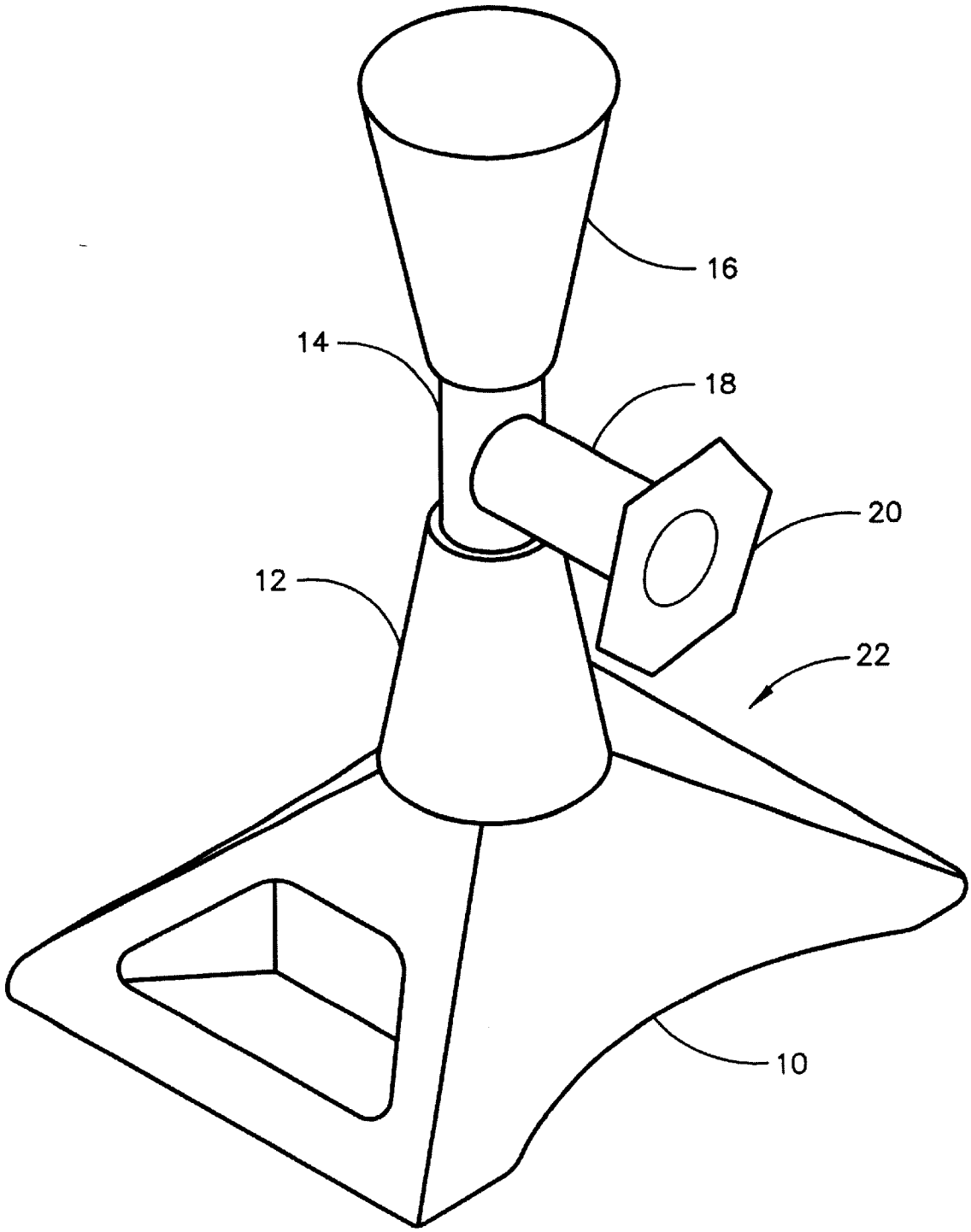
FIG. 3 is an isometric drawing of the subject invention. Sheet 3/3.

A soccer kicking training device according to the present invention 22 is illustrated in FIG. 1 through FIG. 3. The present invention is comprised of a base 10, stationary base connector 12, vertical member 14, top ball holder 16, horizontal member 18, and side ball holder 20. The figures shown illustrate an embodiment of the present invention 22 for purpose of interpretation only. One skilled in the art will readily recognize from the following discussion those alternative embodiments of the structure and methods illustrated herein may be employed without departing from the principles of the claimed invention.

Referring now to FIG. 1, there is shown a top view of a soccer kicking training device in accordance with the present invention 22. Shown is the base 10 in accordance with the present invention 22. Base 10 may have curved sides to allow for ball placement from side ball holder 20. Base 10 may also have handles for transporting to and from the soccer field. Weighted material inside the base keeps the base 10 stabilized due to force or impact when a ball is kicked. Top ball holder 16 is centrally located on base 10. Top ball holder 16 may be conical in shape and curved to fit the curvature of a ball. The present invention 22 is also comprised of a horizontal member 18 protruding from the side of the vertical member 14 and extending to the side ball holder 20. Shown is a horizontal member 18 with rotation to the right or left side of the present invention 22. Side ball holder 20 is attached to the horizontal member 18. Side ball holder 20 is geometric in shape with VELCRO or other suitable material attached to its side to connect the ball to side ball holder 20. Soccer balls are shown in phantom lines to lay reference to their location on the top ball holder 16 and side ball holder 20. Shown on the side ball holder 20 and the top ball holder 16 is a soccer ball of predetermined size. Also shown are phantom lines centrally located on the base 10 to lay reference to the stationary base connector 12 and the vertical member 14. The present invention 22 can be made of any material suitable to withstand vibration, wear and tear from indoor or outdoor use, and provide sufficient tensile strength. It is preferred that each piece of the present invention 22 be constructed of plastic or lightweight metals by well-known plastic and metal molding techniques, keeping the weight of the individual pieces light without sacrificing strength and impact resistance. Reference is also located on FIG. 2.

Referring now to FIG. 2, there is shown a front view of a soccer kicking training device in accordance with the present invention 22. In this illustration, the present invention 22 is shown as consisting of three individual modular pieces comprising a base 10, stationary base connector 12, vertical member 14 with a horizontal member 18. Shown is the front view of base 10 in accordance with the present invention 22. Base 10 may be curved sides to allow for ball placement from side ball holder 20. Base 10 also has handles for transporting to and from the soccer field. Force or impact from when the soccer ball is kicked requires weighted material to keep the base 10 stabilized.

Base 10 contains a centrally located internal cavity perpendicular to the top of base 10. Shown is a stationary base connector 12 protruding upward and affixed centrally on the top of base 10. Stationary base connector is comprised of openings for further height adjustments. Adjustments may be made in increments of inches or may be made to adjust in every quarter or half-inch increments. A vertical member 14 protruding upward sliding inside the stationary base connector 12 to accommodate the various heights used on the present invention 22. Vertical member 14 rotates about its own axis. The present invention 22 further comprising, adjustable locking pins 24 or threaded knobs used to lock in the various heights on the present invention 22. The present invention 22 may also be comprised of a screw adjustment means on the vertical member 14 to allow the various heights adjustments. A top ball holder 16 is coupled and located on top of the vertical member 14. Top ball holder 16 may be conical in shape and curved to fit the curvature of a ball. The present invention 22 is also comprised of a horizontal member 18 protruding from the side of the vertical member 14 and extending to the side ball holder 20. Shown is a horizontal member 18 with rotation to the right or left side of the present invention 22. Shown is a side ball holder 20 attached to the horizontal member 18. Side ball holder 20 is geometrical in shape with VELCRO attached to its side or other suitable material attached to its side to connect the ball to side ball holder 20. Soccer balls are shown in phantom lines to lay reference to their location on the top ball holder 16 and side ball holder 20. Adjustments may be made in increments of inches or may be made to adjust in every quarter or half-inch increments. Shown on the side ball holder 20 and the top ball holder 16 is a soccer ball of predetermined size. The present invention 22 can be made of any material suitable to withstand vibration, wear and tear from indoor or outdoor use, and provide sufficient tensile strength. It is preferred that each piece of the present invention 22 be constructed of plastic or lightweight metals by well-known plastic and metal molding techniques, keeping the weight of the individual pieces light without sacrificing strength and impact resistance.

FIG. 3 shows an isometric drawing of present invention 22. Shown is the present invention 22 with a base 10, stationary base connector 12, vertical member 14, top ball holder 16, horizontal member 18, side ball holder 20, and locking pins 24. Shown are the front, top, and side view.

When the soccer kicking training device is assembled in the desired area, the device is utilized as follows: The player stands on the right side or left side of the present invention 22. The players position themselves at approximately one or two feet from the top ball holder 16 and approximately three feet from the side ball holder 20. The player then approaches the stationary balls and performs a side volley kick from the top ball holder 16 or a front volley using the side ball holder 20. With repetitive practice, the player kicking technique corrects itself in a shorter amount of time. When kicking the ball the player will use the proper kicking principals used in kicking side volleys and front volleys. The player can run up next to the present invention 22 and freeze before they kick the ball into the goal. The coaches and players can see the mistakes they are making before they attempt to kick the ball. The present invention 22 helps players use proper foot positioning and body alignment when kicking the ball. The ball can be raised using the height adjustment, as the player becomes comfortable in using the present invention 22.

Using the device in the above described manner provides the player with the knowledge and training on how to properly kick a side and front volley. In addition, the player benefits in the increase of foot speed and body positioning. Players learn to be equally proficient in using their right and left foot. Because the device is easily transportable, it makes an excellent device that can be used outdoors and indoors.

From the foregoing description of the present invention, it is apparent that many alterations may be made therein. It should be understood that it is intended in the appended claims to cover all such alterations, which are within the scope of the present invention without departing from the scope.

What we claim is:

1. A ball kicking training device comprising:

a base having an upper and a lower surface wherein said upper surface contains a centrally located internal cavity perpendicular to said upper surface;

a stationary base connector attached to said base in said centrally located internal cavity;

a vertical member with an upper end having a vertical adjustment and rotatable about a vertical axis and located inside and contiguous to said stationary base connector;

a top ball holder with conical interface connected to said vertical member at the upper end, said top ball holder to receive and support a first ball and to enable said first ball to rest in an unattached fashion on said top ball holder;

a horizontal member having an outer edge connected to said vertical member;

a ball connector attached to said outer edge of said horizontal member said ball connector adapted to receive and support a second ball in a horizontal position whereby said second ball is detachable from said ball connector upon application of a force to said second ball.

2. The ball kicking training device of claim 1, wherein said base is of predetermined length and height for placement on a surface and including a hand-held opening and weighted material thereof to stabilize said base.

3. The ball kicking training device of claim 1 wherein said base connector is of a predetermined height and diameter including a plurality of holes spaced evenly at a predetermined distance on the vertical axis of said base connector.

4. The ball kicking training device of claim 1 wherein said vertical member is of a predetermined height and diameter extending upwards above said base connector including a plurality of holes spaced evenly at a predetermined distance on the vertical axis of said vertical member with said vertical member adjustment comprised of locking pins.

5. The ball kicking training device of claim 1 wherein said top ball holder is comprised of plastic material.

6. The ball kicking training device of claim 1 wherein said ball connector attached to said outer edge of said horizontal member is comprised of VELCRO.

7. The ball kicking training device of claim 1, wherein said force is applied to said second ball by kicking said second ball.

8. The ball kicking training device of claim 1, wherein said first ball is a first soccer ball and said second ball is a second soccer ball.

9. The ball kicking device of claim 1, wherein said first ball remains at rest on said top ball holder until said first ball is kicked by a user of said ball kicking training device.

* * * * *